United States Patent [19]

Soma et al.

[11] 4,161,361

[45] Jul. 17, 1979

[54] WET TYPE ELECTROPHOTOGRAPHIC APPARATUS

[75] Inventors: Ikuo Soma, Yokohama; Yusaku Takada, Tokyo, both of Japan

[73] Assignee: Canon Kabushiki Kaisha, Tokyo, Japan

[21] Appl. No.: 827,021

[22] Filed: Aug. 23, 1977

[30] Foreign Application Priority Data

Dec. 3, 1976 [JP] Japan ..... 51-145460

[51] Int. Cl.[2] ..... G03G 15/10

[52] U.S. Cl. ..... 355/10; 118/DIG. 23; 427/15

[58] Field of Search ..... 355/10; 427/16, 15; 118/659, 660, DIG. 23; 96/1 LY

[56] References Cited

U.S. PATENT DOCUMENTS

| | | | |
|---|---|---|---|
| 3,741,643 | 6/1973 | Smith et al. | 118/DIG. 23 |
| 3,760,152 | 9/1973 | Saito et al. | 34/1 X |
| 3,811,914 | 5/1974 | Saito et al. | 96/1 LY X |
| 3,957,016 | 5/1976 | Yamada et al. | 118/DIG. 23 |
| 3,972,611 | 8/1976 | Tanaka et al. | 118/DIG. 23 |

*Primary Examiner*—R. L. Moses

*Attorney, Agent, or Firm*—Fitzpatrick, Cella, Harper & Scinto

[57] ABSTRACT

An electrophotographic apparatus is provided with a squeezer for removing unnecessary liquid from a liquid layer formed on a movable photosensitive medium between the step of developing an electrostatic latent image formed on the photosensitive drum by liquid developer and the step of fixing the toner image formed thereby on the photosensitive medium or transferring such toner image to a transfer medium. The apparatus is further provided with a non-contact squeeze power forming device such as a corona discharger or air knife for damming up the unnecessary liquid, and also provided with a liquid layer control member for contacting the liquid dammed up and bulged into a crest-like form so that the thickness of the liquid flowing down the surface of the photosensitive medium is uniform. At least a portion of the liquid-contacting surface of this member forms a planar or a convexly curved surface having a progressively increasing spacing with respect to the photosensitive medium in the direction opposite to the direction of movement of the photosensitive medium.

28 Claims, 19 Drawing Figures

WET TYPE ELECTROPHOTOGRAPHIC APPARATUS

BACKGROUND OF THE INVENTION

1. Field of the Invention

This invention relates to an electrophotographic apparatus, and more particularly to improvements in an electrophotographic apparatus wherein an electrostatic latent image formed on a latent image bearing member is developed by liquid developer and then any unnecessary developing liquid is removed from the latent image bearing member.

2. Description of the Prior Art

Generally, in the wet development type electrophotographic apparatuses, it has been practised to remove any excess developing liquid remaining on the surface of the latent image bearing member after the development. This is for the following reason. In the apparatuses of the type wherein the developed toner image is transferred to paper or other transfer medium, when the transfer medium is urged against the latent image bearing member having a great deal of developing liquid thereon, there may occur a violent flow of liquid which may disturb the toner image electrostatically adsorbed to the bearing member, or toner particles suspended in a thick layer of liquid may stick to the transfer medium to cause fog, or a great deal of liquid may stick to the transfer medium to cause the need for a great deal of heat to dry the transfer medium, which in turn may result in production of a lot of air-contaminating gases. Also, in the apparatuses of the type wherein the developed toner image is directly fixed on the latent image bearing member, if the fixing process is effected with a great deal of developing liquid remaining on the latent image bearing member, there may likewise occur fog and a great deal of heat may be required for drying which may also result in undesirable production of much noxious vapor.

There is a diversity of electrophotographic apparatuses in which unnecessary developing liquid is removed after the development, and examples of the electrophotographic apparatus of the type similar to the present invention in which the means for forming the power of squeezing the unnecessary developing liquid is not in contact with the developing liquid are disclosed in U.S. Pat. Nos. 3,369,918, 3,627,410 and 3,741,643, or U.S. Pat. Nos. 3,722,994 and 3,760,152, etc. The first three patents pertain to the apparatus in which compressed air is blown against the developing liquid on the latent image bearing member to remove the unnecessary developing liquid, and the latter two patents pertain to the apparatus in which corona discharge is applied to the developing liquid to squeeze and remove the unnecessary developing liquid. In any of these patents, the means for producing the squeeze power (such as corona discharge electrode or air injection nozzle) is spaced apart from the developing liquid and thus, from the latent image bearing member, and this avoids the inconvenience that such means mechanically injures the latent image bearing member or the toner image formed thereon, whereas thereis left the disadvantage that the squeeze power tends to become irregular with respect to the widthwise direction of the latent image bearing member, namely, the direction perpendicular to the direction of movement of the latent image bearing member relative to the squeeze power forming means. This is attributable to the extreme difficulties encountered by the air knife developing liquid removal device in forming an air stream injected under uniform pressure with respect to the widthwise direction of the latent image bearing member, or to the difficulties encountered by the corona discharge developing liquid removal device in producing uniform corona discharge with respect to the widthwise direction of the latent image bearing member.

If the squeeze power becomes irregular with respect to the widthwise direction of the latent image bearing member as described, the thickness of the developing liquid layer squeezed and flowing down the latent image bearing member may also become irregular, so that streak-like density irregularities may occur to the toner image formed on the surface of the latent image bearing member. The reason for this is that toner particles still available for the development are suspended in the developing liquid layer squeezed and flowing down the latent image bearing member and the quantity of such toner varies in accordance with the variation in thickness of the liquid layer. Also, the thickness of the squeezed liquid becomes irregular and accordingly, the thickness of the developing liquid layer left on the latent image bearing member necessarily becomes irregular with respect to the widthwise direction of the latent image bearing member and this causes variations in the electrical drifting force of the toner in the liquid during the transfer of the toner image onto paper or the like, which in turn may adversely effect the quality of the transferred image.

Therefore, in the electrophotographic apparatus using corona discharge to remove the unnecessary developing liquid, it has heretofore been the practice that an insulative converging plate disposed adjacent to the opening of the shield member of the corona discharger to permit a corona discharge flow to be applied to a region of narrow width at a high density (see U.S. Pat. No. 3,760,152) is brought into uniform contact with the developing liquid dammed up and bulged by the application of the corona discharge, thereby the thickness of the squeezed developing liquid layer is uniform or even. According to this, however, a long time has been required from the initial contact of a portion of the squeezed developing liquid with the converging plate till the completion of uniform contact of such liquid with the entire surface of the converging plate, and much time has also been necessary from the stoppage of the corona discharge till the drain-off of the developing liquid from the converging plate. That is, in addition to the time required for the intended image processing steps such as development and transfer, it has been necessary to provide a long preparation time for uniforming the thickness of the squeezed developing liquid and a post-process time for draining the developing liquid off the surface of the latent image bearing member (if this latter time is long, some of the developing liquid will inconveniently dry up and stick to the surface of the latent image bearing member). Moreover, there has been such a disadvantage that the developing liquid comes into the interior of the corona discharger from the edge of the opening of the converging plate to contaminate the shield member and/or the discharge electrode to reduce the squeeze power.

SUMMARY OF THE INVENTION

It is a principal object of the present invention to provide a wet type electrophotographic apparatus which may overcome the above-noted disadvantages peculiar to the conventional apparatuses and which is provided with improved developing liquid removal means of simple construction.

It is another object of the present invention to provide an improved wet type electrophotographic apparatus which is provided with squeeze power forming means which is out of contact with the developing liquid, such as a corona discharge electrode or gas stream injection nozzle, and which is capable of making the thickness of the squeezed developing liquid uniform.

It is still another object of the present invention to provide a wet type electrophotographic apparatus which is provided with squeeze power forming means of the described non-contact type and which is capable of quickly making the thickness of the squeezed developing liquid uniform.

It is yet still another object of the present invention to provide a wet type electrophotographic apparatus which is provided with squeeze power forming means of the described non-contact type and which is capable of quickly making the thickness of the squeezed developing liquid uniform and also capable of stably maintaining the uniform thickness of the squeezed liquid.

It is a further object of the present invention to provide a wet type electrophotographic apparatus which is provided with squeeze power forming means of the described non-contact type and which is capable of quickly making the thickness of the squeezed developing liquid uniform and also capable of quickly draining the developing liquid off the latent image bearing member after deenergization of the squeeze power forming means.

It is a further object of the present invention to provide a wet type electrophotographic apparatus which is provided with squeeze power forming means of the described non-contact type and which is capable of quickly making the thickness of the squeezed developing liquid uniform and stably maintaining the uniform thickness of the liquid and also capable of quickly draining the developing liquid off the latent image bearing member after deenergization of the squeeze power forming means.

It is a further object of the present invention to provide a wet type electrophotographic apparatus which is provided with a corona discharge for removing unnecessary developing liquid and a uniforming member adapted for contacting the squeezed developing liquid to make the thickness thereof uniform and in which the corona discharger is protected against contamination by the developing liquid.

Generally describing, the wet type electrophotographic apparatus of the present invention employs, as the means for removing unnecessary developing liquid from a latent image bearing member, squeeze power forming means such as a corona discharger or a compressed gas injection nozzle which is out of contact with the liquid, and a liquid thickness evening member disposed for contact with the developing liquid dammed up and bulged by the action of the squeeze power forming means, the liquid thickness evening member having a planar or a curved surface having a progressively increasing spacing with respect to the latent image bearing member in the direction in which the squeezed developing liquid flows down the latent image bearing member.

The above objects and other features of the present invention will become fully apparent from the following detailed description of the invention taken in conjunction with the accompanying drawings.

DESCRIPTION OF THE PREFERRED EMBODIMENTS

Figure 1:
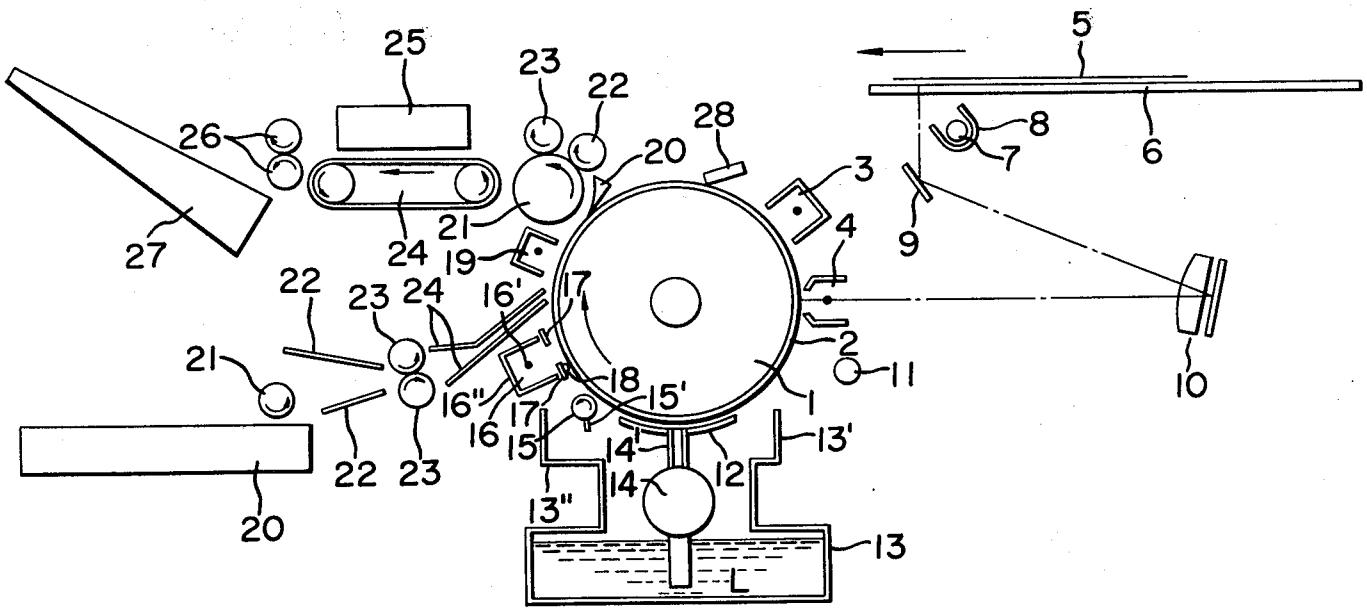
FIG. 1 illustrates the electrophotographic apparatus to which the present invention is applied.

FIG. 1 schematically illustrates an embodiment of the present invention. A photosensitive drum 1 has a photosensitive layer 2 around it which comprises an electrically conductive layer, a photoconductive layer and a transparent insulating layer successively layered in the named order. The drum 1 is rotated at a constant velocity in the direction of the arrow by a motor, not shown. The photosensitive layer 2 is first charged uniformly by a DC corona discharger 3. The charging polarity may be positive where the photoconductor is an N-type semiconductor, and negative where the photoconductor is a P-type semiconductor. After having passed by the corona discharger 3, the photosensitive layer 2 is subjected to slit-exposure of the image light from an original 5 and simultaneously therewith, subjected to AC discharge from a corona discharger 4 or DC corona discharge of the opposite polarity to the discharger 3. The original 5 to be copied rests on a transparent original supporting carriage 6 which is moved at a constant velocity in the direction of the arrow by a conventional moving mechanism in synchronism with the rotation of the drum 1. The original 5 is illuminated by a lamp 7 accompanied by a condensing mirror 8, so that the image on the region of the original so illuminated is directed by a photographic optical system comprising a mirror 9 and an in-mirror lens 10, and projected upon the photosensitive layer 2 through the optical slit opening of the corona discharger 4. By the simultaneous application of the image light and the discharge effected by the above-described various means, a charge pattern corresponding to the original 5 is formed on the photosensitive layer 2, whereafter the whole surface of the photosensitive layer 2 is subjected to uniform exposure by a lamp 11, whereby an electrostatic latent image with high contrast is formed on the photosensitive layer 2. Designated by 12 is a dish-shaped developing electrode disposed in a predetermined spaced apart relationship with the photosensitive layer 2. The developing electrode 12 is electrically insulated from any other member or supplied with a suitable voltage. Developing liquid L (which consists of coloring insulative toner charged to the same or the opposite polarity to the surface potential corresponding to the dark region of the latent image and suspended in an insulative carrier liquid) is supplied from a reservoir 13 by a pump 14 through a pipe 14' to fill the gap between the developing electrode 12 and the photosensitive layer 2. Toner is electrostatically attracted to the photosensitive layer 2 in accordance with the formed electrostatic latent image, thereby forming a visible image. The portion of the developing liquid overflowing from the opposite ends of the developing electrode 12 may either directly return into the reservoir 13 or fall into troughs 13' and 13" and then return into the reservoir 13.

Designated by 15 is a roller disposed in a predetermined spaced apart relationship with the photosensitive layer 2 so that it may be dipped in the residual developing liquid remaining on the photosensitive layer 2 after having passed by the developing electrode 12. The roller 15 is operatively associated with the drum 1 by a conventional rotation transmitting means so as to be rotated in the same or the opposite direction with the drum 1. The roller 15 is electrically conductive and grounded or supplied with a voltage of the opposite polarity to the toner. Thus, the roller 15 removes a portion of the unnecessary developing liquid to leave a thickness of liquid corresponding to the spacing between the roller and the photosensitive layer, thereby performing the pre-squeezing function of reducing the duty of a corona discharger 16 which will next be described, and also performing the function of eliminating any fog. Thus, the roller also performs the function of adsorbing any toner sticking to the region of the photosensitive layer 2 to which the toner should not stick, namely, the ground region of the image. The toner and carrier adsorbed by the roller 15 is wiped off either immediately or by a blade 15' urged against the roller 15, and then falls into the trough 13' to return into the reservoir 13. Note, however, that this roller 15 is not always necessary.

The corona discharger 16 has a wire-like discharge electrode 16' connected to a high DC voltage source and a grounded shield member 16" surrounding the electrode 16' except for the discharge current passage opening, and is disposed in opposed relationship with the photosensitive layer 2 past the roller 15 from where the drum 1 begins to increase its velocity of rotation.

The corona discharger 16 applies corona discharge of any desired polarity to the surface of the insulative developing liquid layer on the photosensitive layer 2. The polarity of such discharge is preferably of the same as the toner. This is because the charge on the surface of the developing liquid layer achieves the effect of electrostatically urging the toner image against the photosensitive layer and the effect of fixing the toner image thereon. In any case, charge of the opposite polarity to the charge on the developing liquid surface is induced on the photosensitive layer 2, whereby the developing liquid surface becomes depressed. On the other hand, the photosensitive layer 2 with a developing liquid layer retained thereon passes by the corona discharger 16, so that the developing liquid becomes dammed up and bulged by the above-mentioned corona discharge and flows down the photosensitive layer from gravity. To permit the corona discharge to be applied over a narrow width but at a high density, a corona converging member 17 comprising an electrically insulative plate or an electrically conductive plate electrically insulated from the others is disposed to form an opening having a narrower width than the opening of the shield member 16" between the opening portion of the shield member 16" and the photosensitive layer 2. The squeeze power is enhanced by the action of this converging member 17. The portion of the converging member 17 which is upstream with respect to the direction of movement of the photosensitive layer 2 has attached thereto a liquid thickness evening member 18 which may contact the developing liquid dammed up and bulged into the form of a peak or a crest. The developing liquid squeezed is made into a uniform thickness by a member 18 projected near the region in which the corona discharge acts on the developing liquid, as will further be described. Of course, the discharge electrode 16', the slit-like opening formed by the converging member 17 and the evening member 18 are disposed parallel to the rotational axis of the drum 1 as are the developing electrode 12, the roller 15 and other corona dischargers, namely, in a direction perpendicular to the direction of movement of the photosensitive layer 2, and they each have at least a sufficient length to cover the image formation area of the photosensitive layer 2.

After the unnecessary developing liquid on the photosensitive layer 2 has been removed by the squeeze power provided by the corona discharger 16, the photosensitive layer 2 having left thereon a developing liquid layer necessary for the image transfer, namely, required to be electrically drifted from the photosensitive layer 2 to a transfer medium, progresses to an image transfer station. At the image transfer station, a corona discharger 19 for effecting discharge of the opposite polarity to the toner is opposed to the photosensitive layer 2. The corona discharger 19 applies corona discharge to a transfer medium such as paper or the like conveyed there from a supply cassette 20 via a conventional conveyor mechanism comprising delivery roller 21, guide plate 22, timing rollers 23 and guide plate 24, in synchronism with the rotation of the drum 1, and brought into contact with the photosensitive layer 2 bearing a toner image thereon, thereby causing the toner image to be transferred from the photosensitive layer 2 to the transfer medium. After the image transfer, the transfer mechanism is separated from the photosensitive layer 2 by a pawl 20 and delivered into the nip between a roller 21 and rollers 22, 23 frictionally rotating in pressure contact with the roller 21, so that the transfer medium is further delivered into a drying-fixing device. The drying-fixing device comprises an endless belt mechanism 24 for conveying the transfer medium and a heater 25 containing a heating member therewithin. The toner image bearing transfer medium wet with carrier liquid is conveyed just below the heater by the belt 24, whereby the transfer medium is dried to thermally fix the toner image thereon. Thereafter, the transfer medium is discharged onto a tray 27 by a discharge roller 26. On the other hand, any toner and carrier liquid remaining on the photosensitive layer 2 after the image transfer is wiped off by a rubber blade 28 urged against the photosensitive layer 2, and the photosensitive layer thus cleaned becomes ready for another cycle of image process similar to what has been described above.

Figure 2:
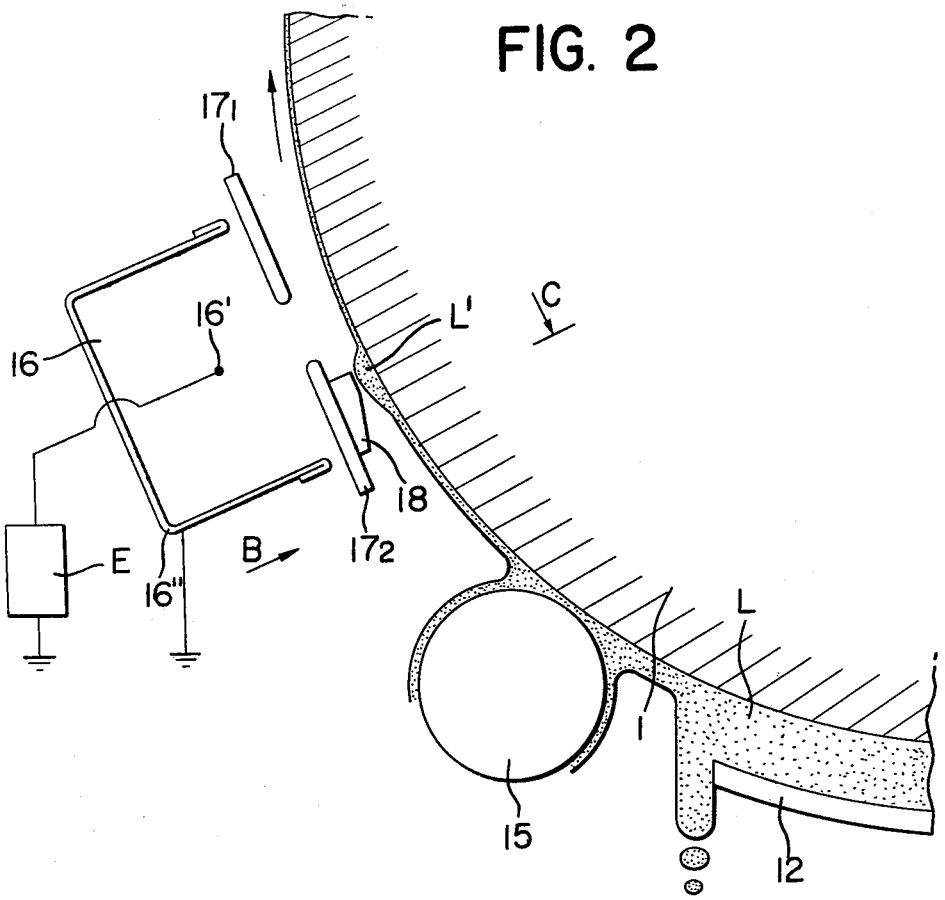
FIG. 2 illustrates essential portions of an embodiment of the present invention.
Figure 3:
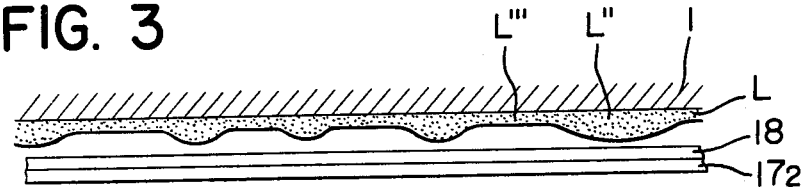
FIGS. 3 and 4 illustrate streak-like downflow of unnecessary developing liquid squeezed and removed.
Figure 4:
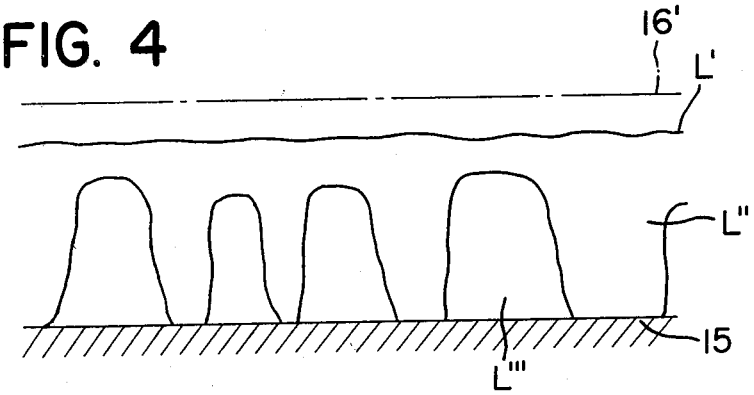
Figure 5:
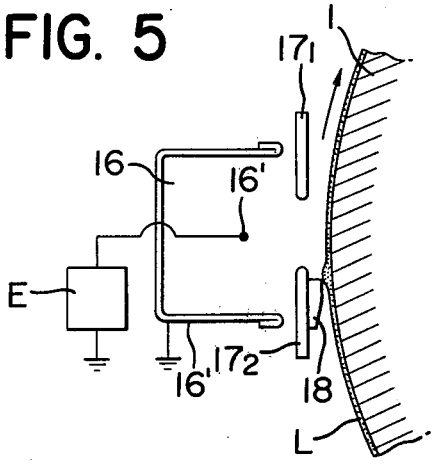
FIGS. 5, 6A, 6B and 7 illustrate the process from initial contact of the developing liquid with the liquid thickness uniforming member to the completion of the contact.
Figure 6B:
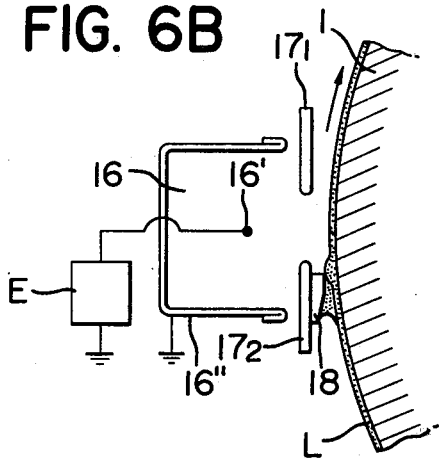
Figure 6A:
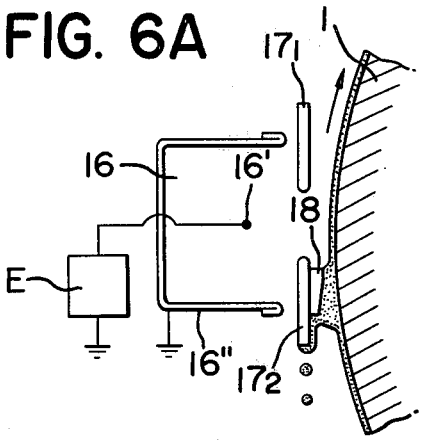
Figure 7:
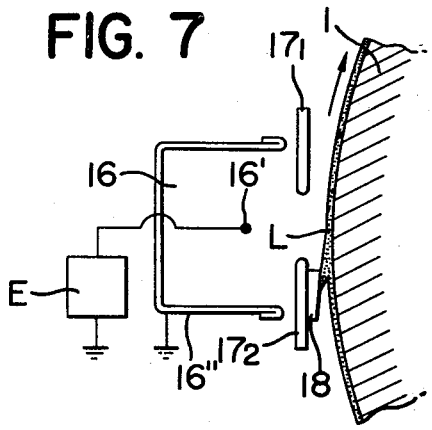

An embodiment of the present invention will be described in greater detail. FIG. 2 shows a position immediately after the DC voltage source E has been connected to the electrode 16'. The magnitude of the voltage applied (the polarity of which may preferably be the same as that of the toner to achieve the aforementioned fixation effect) is set so as to form an electric field which will be capable of leaving the necessary quantity of developing liquid for image transfer and removing unnecessary liquid, in correlation with the rotational velocity of the drum 1, the viscosity of the developing liquid L, the distance between the electrode 16' and the photosensitive layer, etc. As already noted, when corona discharge is started, the unnecessary quantity of developing liquid remains on the photosensitive layer of the drum 1 is electrostatically dammed up irrespective of the rotation of the photosensitive layer and bulges as indicated at L'. On the other hand, the discharge current emitted from the electrode 16' does not become uniform in any portion of the electrode wire but becomes stronger from points slightly spaced apart from the electrode wire. Thus, the developing liquid squeeze power does not become uniform with respect to the widthwise direction of the photosensitive layer and the bulge of the liquid is irregular as shown in FIG. 3. In FIG. 3, which shows the bulge of the developing liquid between the photosensitive layer and the converging member $17_2$ as seen in the direction of arrow C in FIG. 2, the bulge of the developing liquid progresses while having higher portions L'' and lower portions L''' in accordance with the irregularities of the discharge. When this occurs, the developing liquid flows down the photosensitive layer in the form of a stream having irregular heights corresponding to the heights of the bulged peaks. Such conditions are illustrated in FIG. 4, which is a view of the developing liquid layer between the corona discharge applying position and the roller 15 as seen in the direction of arrow B in FIG. 2. Here, if the member 18 is absent, the developing liquid squeezed not only immediately after the voltage has been applied to the electrode 16' but also throughout the operation of the copying apparatus will continue to assume the irregular conditions as shown in FIGS. 3 and 4. In the squeezed developing liquid, as already described, the toner still having the capability of developing latent image is suspended and therefore, if the developing liquid flows down in the form as shown in FIG. 4, the resultant developed image would present irregular densities in a streak-like pattern. Also, the thickness of the developing liquid film remaining on the photosensitive layer after having passed by the squeezing corona discharge applying position would suffer from irregularities conversely corresponding to the difference in height between the peaks L'' and L''' of FIG. 3, thus resulting in irregular image transfer effect. According to the present invention, however, in a little time after the discharge has been started, the dammed developing liquid bulges even higher and a portion of the so bulged liquid contacts the member 18 (which is attached to the lower portion of that side of the converging member 17 on which the bulge of the developing liquid is produced). When a portion of the bulged developing liquid comes into contact with the member 18, the area of contact therebetween gradually increases until the developing liquid covers the whole surface of the member 18. Thus, the thickness of the bulged developing liquid is made uniform with respect to the widthwise direction of the photosensitive layer by the member 18. Once the discharge is started, the developing liquid first bulges as shown in FIG. 5, and then the highest portion of the bulge comes into contact with the upper part of the member 18 which is more downstream with respect to the direction of movement of the photosensitive layer, whereafter the developing liquid widens its area of contact laterally so as to cover all the surface of the member 18, while widening its area of contact also downwardly, until the condition as shown in FIG. 6A or 6B is attained. In FIG. 6A, a portion of the developing liquid which is in contact with the member 18 flows down the upstream side converging member $17_2$ and drips from the lower end thereof. The drips of liquid come into the trough 13' of FIG. 1 and return into the reservoir 13, while the developing liquid flowing down the photosensitive layer of the drum 1 is dammed up by the roller 15 and falls into the trough 13'' and likewise returns into the reservoir 13. In FIG. 6B, the amount of developing liquid removed is relatively small or the spacing between the member 18 and the photosensitive layer is relatively wide, so that there is no developing liquid flowing down the member $17_2$. Next, when the voltage source E is stopped from operating, namely, when the corona discharge is stopped, the power of squeezing the developing liquid disappears and the photosensitive layer is rotating upwardly, so that the developing liquid which has so far been in contact with the member 18 subsides from the lower portion of the member 18 as shown in FIG. 7, that is, the non-contacting portion of the member 18 with the liquid gradually spreads from the bottom toward the top of the member until there is no contact between the developing liquid and the member 18. When the rotation of the drum 1 is stopped or when the supply of developing liquid into between the electrode 12 of FIG. 1 and the photosensitive layer is stopped, the developing liquid which has so far sticked to the photosensitive layer begins to flow down the photosensitive layer back to the reservoir 13. Thus, the developing liquid becomes null on the photosensitive layer.

Figure 10:
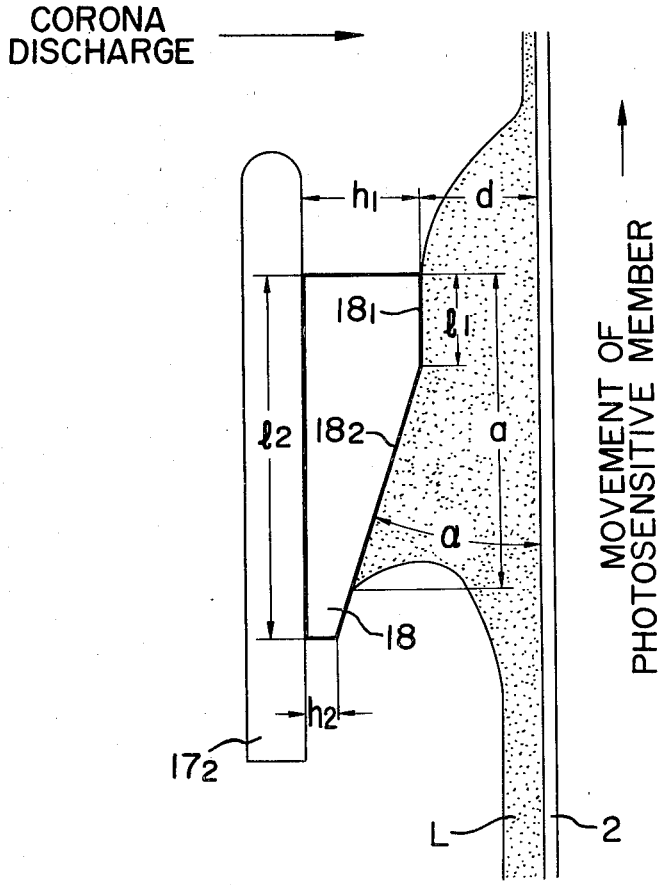
FIG. 10 illustrates a form of the liquid thickness evening member according to the present invention.

In the figures of the drawings referred to above, the liquid thickness evening member 18 disposed for contact with the developing liquid dammed up and bulged by the corona discharge is not of a simple rectangular cross-section as taken along a plane parallel to the direction of movement of the photosensitive layer, namely, the plane of the drawing sheet. In other words, the surface of the shown liquid thickness uniforming member 18 which is opposed to the photosensitive layer comprises a surface region $18_1$ substantially parallel to the photosensitive layer 21 and a surface region $18_2$ obliquely inclined with respect to the surface $18_1$, as best seen in FIG. 10. More particularly, the surface region $18_1$ lies above the surface region $18_2$, or downstream of the surface region $18_2$ with respect to the direction of movement of the photosensitive layer 2 which is upwardly moving, and the spacing between the surface region $18_2$ and the photosensitive layer 2 is progressively increased toward the downward or upstream side with respect to the movement of the upwardly moving photosensitive layer 2. Such a special configuration of that surface of the member 18 which is opposed to the photosensitive layer 2 or which is contacted by the bulged developing liquid is for the purpose of quickly evening the thickness of the squeezed and bulged developing liquid, stably maintaining the so uniformed thickness of the liquid, and quickly eliminating the contact of the developing liquid with the member 18 upon disappearance of the squeezing power.

Figure 8:
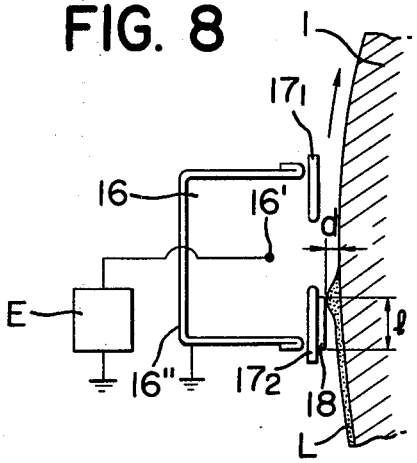
FIG. 8 illustrates an example of the liquid thickness evening member.
Figure 9:
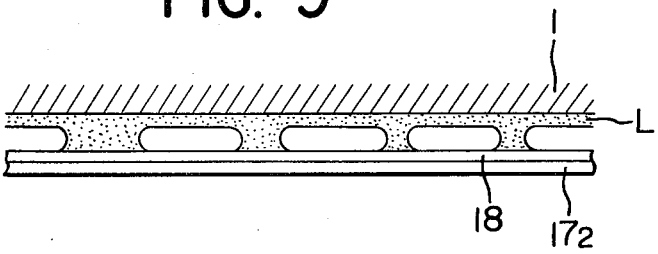
FIG. 9 illustrates the state of unstable contact between the liquid thickness evening member and the developing liquid.

These purposes would be well understood if a device as shown in FIG. 8 was assumed in which the member 18 was of a simple rectangular cross-section and attached to the converging member $17_2$ so that one surface thereof was opposed substantially parallel to the photosensitive layer. In FIG. 8, let d be the distance from the photosensitive layer to the surface of the member 18 which is contacted by the liquid, and l be the length of the member 18 in the direction of movement of the photosensitive layer. As d is smaller, the thickness of the bulged developing liquid becomes more quickly uniform and more stably maintained so, but a longer time is required to eliminate the contact between the member 18 and the developing liquid after the corona discharge is stopped. As d is greater, the more converse effect will occur. As l is greater, a longer time will be required before the thickness of the bulged developing liquid becomes uniform, and a more time will be taken to eliminate the contact between the liquid and the member after the corona discharge is stopped, but the uniform thickness of the bulged liquid will be more stably maintained. As l is greater, the effect will be more converse. Here, the failure of the liquid thickness to be stably maintained uniform refers to the state as shown in FIG. 9, that is, the state in which the developing liquid L and the member 18 are in contact with each other only here and there and not generally uniformly and the locations of contact are unstably displaceable.

As will be seen in FIG. 8, both d and l should preferably be small to ensure the developing liquid to contact the member 18 more quickly and uniformly, d should be small while l should be great to stabilize the uniform contact, and d should be great while l should be small to eliminate the contact between the liquid and the member after the discharge is stopped. With all these taken into account, the liquid thickness uniforming member used with the present invention has been made.

Referring again to FIG. 10, too small a value for d would disturb the toner image on the photosensitive layer 2 or would require much time for the liquid to be drained off after the stoppage of the corona discharge. Too great a value for d would require much time for the developing liquid to make uniform contact and encounter difficulties in providing uniform contact. Where the viscosity of the developing liquid is high or where the velocity of the photosensitive layer is high, the value of d can be relatively small. Generally speaking, the values of d ranging from 0.2 to 0.8 mm have been empirically found to be appropriate. Too small a value for $l_1$, which is the width of the surface first contacted by the developing liquid, would make the uniform contact of the developing liquid unstable, and too great a value for $l_1$ would lead to much time required for the liquid to be drained off after the stoppage of the corona discharge. Where the viscosity of the developing liquid is high, the value of $l_1$ may be relatively small and where the moving velocity of the photosensitive layer 2, the value of $l_1$ may be relatively great. The values of $l_1$ ranging from about 0.5 to about 3.0 mm have been empirically found to be generally appropriate. The sloped surface $18_2$, which is the surface contacted by the liquid next to the surface $18_1$, has the important functions of increasing the area of contact of the developing liquid to stably maintain uniform contact and quickly draining off the liquid due to the inclination of that surface with respect to the photosensitive layer 2 after the stoppage of the corona discharge. Therefore, too great a length of the sloped surface $18_2$, and thus too small a value of $l_2$ in FIG. 10, would make unstable the uniform contact between the liquid and the member 18 and in this connection, $l_2 \geqq 3l_1$ has been empirically found to be appropriate. A higher viscosity of the developing liquid permits the value of $l_2$ to be smaller, and a higher velocity of movement of the photosensitive layer 2 permits the value of $l_2$ to be greater. If the angle $\alpha$ formed by the sloped surface $18_2$ with the photosensitive layer 2, which is represented as $$\alpha = \tan^{-1}\frac{h_1 - h_2}{l_2 - l_1}$$

in FIG. 10, is too great, the length of contact a of the liquid will be reduced to make uniform contact unstable. The values of $\alpha$ ranging from 10° to 30° has been empirically found to be generally appropriate.

Data of the actually marketed apparatus to which the present invention has been applied will hereinafter be mentioned. In FIG. 1, the drum was rotated at a peripheral velocity of 57 mm/sec. The wire-like electrode 16' of the corona discharger 16 was disposed at a location angled at 45° with respect to the horizontal passing through the rotational axis of the drum 1, and at a distance of 14.0 mm from the photosensitive layer 2. The electrostatic latent image formed on the photosensitive layer 2 was such that the portion thereof corresponding to the dark portion of the optical image assumed a positive potential, and the development was effected by the use of a developing liquid consisting of negatively charged toner dispersed in a carrier liquid (the viscosity of the developing liquid is about 1.5 cps at 25° C.). A DC voltage of −7.5 KV was applied to the discharge electrode 16'. The width of the opening formed by the corona discharge converging member 17 (the spacing between $17_1$ and $17_2$) was 4 mm. Using the symbols seen in FIG. 10, $d=0.5$ mm, $l_1=1.0$ mm, $l_2=5.0$ mm, $h_1=1.6$ mm and $h_2=0.5$ mm. Before reaching the developing liquid removal means, the photosensitive layer had formed thereon a layer of developing liquid having a thickness of about 20$\mu$, but after having passed by that position, the photosensitive layer had only retained thereon a developing liquid layer having a uniform thickness of about 2$\mu$, which means that a liquid layer as thick as about 18$\mu$ could uniformly be removed from the photosensitive layer over the entire width thereof. Only a very short time was required from the start of the corona discharge till the streak-like flow as shown in FIG. 4 disappeared in the developing liquid flowing down the photosensitive layer, and the developing liquid uniformly contacted the member 18. Also, only a very short time was required from the stoppage of the corona discharge till the liquid was drained off the member 18. Thus, the resulting copy image was free of the traces of the streak-like irregular densities and irregular transfer effect which would otherwise have resulted from irregular squeeze of unnecessary developing liquid. Further, both the member 18 and the photosensitive layer 2 were free of dry deposited toner which would otherwise have resulted from ineffective drainage of the developing liquid from the member 18.

Figure 11:
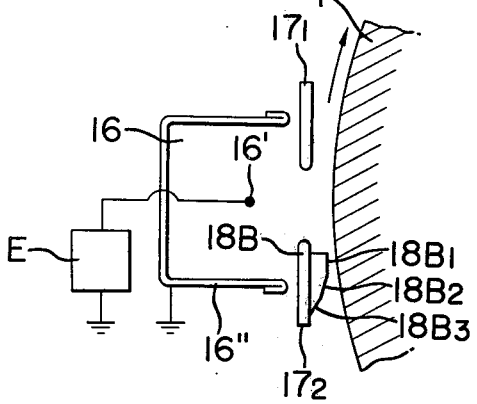
FIGS. 11 and 12 illustrate further forms of the liquid thickness evening member according to the present invention.

In the embodiment described above, the liquid-contacting surface of the liquid thickness evening member comprises a planar surface substantially parallel to the photosensitive layer and a sloped planar surface downwardly contiguous with said planar surface, but as shown in FIG. 11, the liquid-contacting surface of the liquid thickness evening member 18B may comprise an uppermost planar surface $18B_1$ substantially parallel to the photosensitive layer, and a plurality of, say, two, successive lower sloped planar surfaces $18B_2$ and $18B_3$. The angle of inclination of the sloped surface $18B_3$ with respect to the photosensitive layer is greater than that of the sloped surface $18B_2$.

Figure 12:
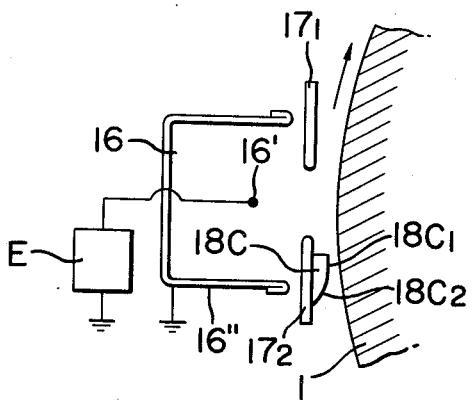

Alternatively, as shown in FIG. 12, the liquid-contacting surface of the liquid thickness uniforming member 18C may comprise a planar surface $18C_1$ substantially parallel to the photosensitive layer and a downwardly contiguous convexly curved surface $18C_2$ such as a circular pillared surface of the like. The gap between the curved surface $18C_2$ and the photosensitive layer is progressively increased in the direction opposite to the direction of movement of the photosensitive layer. As a further alternative, the entire liquid-contacting surface may comprise a single convexly curved surface such as a parabolically curved or an elliptically curved surface, desirably with the upper portion thereof being substantially parallel to the photosensitive layer.

Figure 13:
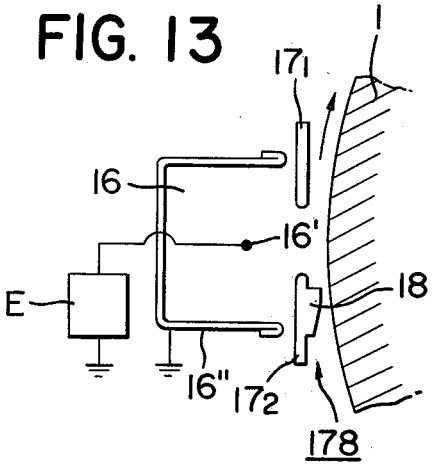
FIG. 13 shows an example in which the corona discharge converging member and the liquid thickness evening member are integrally formed by molding.

In each of the foregoing embodiments, the liquid thickness uniforming member is attached to the corona discharge converging member $17_2$, but as shown in FIG. 13, use may be made of a member 178 formed by integrally molding the corona discharge converging member $17_2$ and the liquid thickness uniforming member 18.

Figure 14:
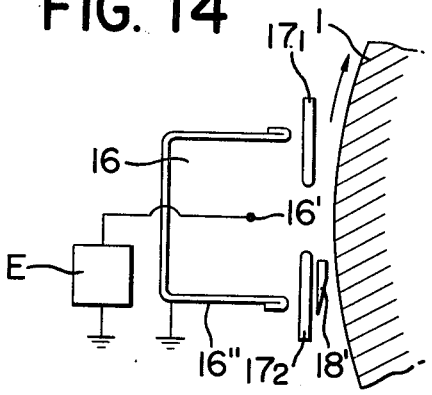
FIG. 14 illustrates another mode of arrangement of the liquid thickness evening member.

Also, in each embodiment described above, the developing liquid contacts the liquid thickness uniforming member and this leads to a greatly reduced possibility of the developing liquid entering into the corona discharger to stain the same than in the conventional apparatus wherein the developing liquid contacts the corona discharge converging member. However, as the apparatus is used for a long period of time, toner tends to build up in the recessed portion defined by the converging member and the liquid thickness evening member and to fill up such recessed portion so that the developing liquid becomes ready to flow therethrough into the interior of the corona discharger. To prevent this, as shown in FIG. 14, the liquid thickness evening member 18' may be spaced apart from the corona discharge converging member $17_2$ and disposed between this member $17_2$ and the photosensitive layer. Of course, the member 18' is disposed so as to permit the developing liquid bulged by the corona discharge to stably and uniformly contact the member 18', and the upper end of the liquid thickness evening member 18' may be located at a level below the lower edge of the opening formed by the converging members $17_1$ and $17_2$. The liquid-contacting surface of the member 18' may of course be variously configured as already noted.

Figure 15A:
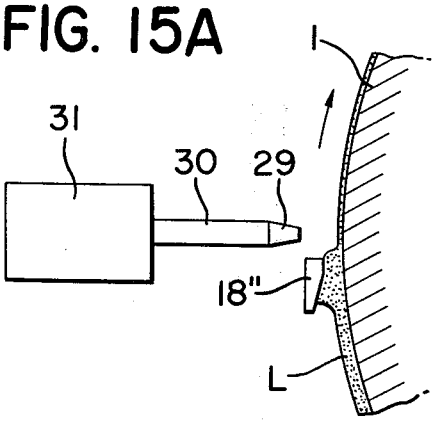
FIGS. 15A, 15B and 15C illustrate an embodiment which employs an air knife as squeeze power forming means.
Figure 15B:
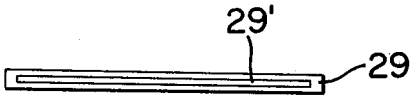
Figure 15C:
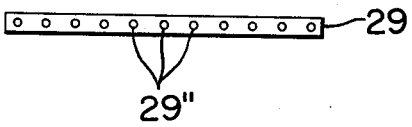

Each of the above-described embodiments employs a corona discharger as the means for producing the developing liquid squeeze power, whereas any other type of means which would produce the squeeze power without contacting the developing liquid could be employed. This is because such non-contact type means would encounter difficulties in producing uniform squeeze power with respect to the widthwise direction of the photosensitive layer. In FIG. 15A, for example, an air knife is used in place of the corona discharger 16 for removing the unnecessary liquid used in the apparatus of FIG. 1. Designated by 29 is an air blast nozzle disposed in opposed relationship with the photosensitive drum 1 and designed to blow compressed air delivered from a pneumatic pump 31 through a pump 30 against the developing liquid on the photosensitive layer. Since such compressed air depresses the developing liquid layer as does the already mentioned corona discharge, unnecessary developing liquid is dammed up and bulged with the rotation of the drum 1, and then flows down the photosensitive layer. A liquid thickness evening member 18'' similar to what has already been described is disposed so as to uniformly contact the bulged developing liquid. The member 18'' evens out the thickness of the removed developing liquid film with respect to the widthwise direction of the photosensitive layer. The nozzle 29 may be either the one as shown in FIG. 15B which has a flattened injection port 29' having a sufficient length to cover the width of the photosensitive layer, or the one as shown in FIG. 15C which is provided with a number of small injection ports 29'' formed at predetermined intervals within a sufficient range to cover the width of the photosensitive layer. In either case, the nozzle 29 is desirably disposed substantially perpendicular to the direction of movement of the photosensitive layer as is the uniforming member 18''. Even the nozzle having the injection port as shown in FIG. 15B produces the irregularities in squeeze power because a pressure drop occurs in the lengthwise direction of the opening.

Figure 16:
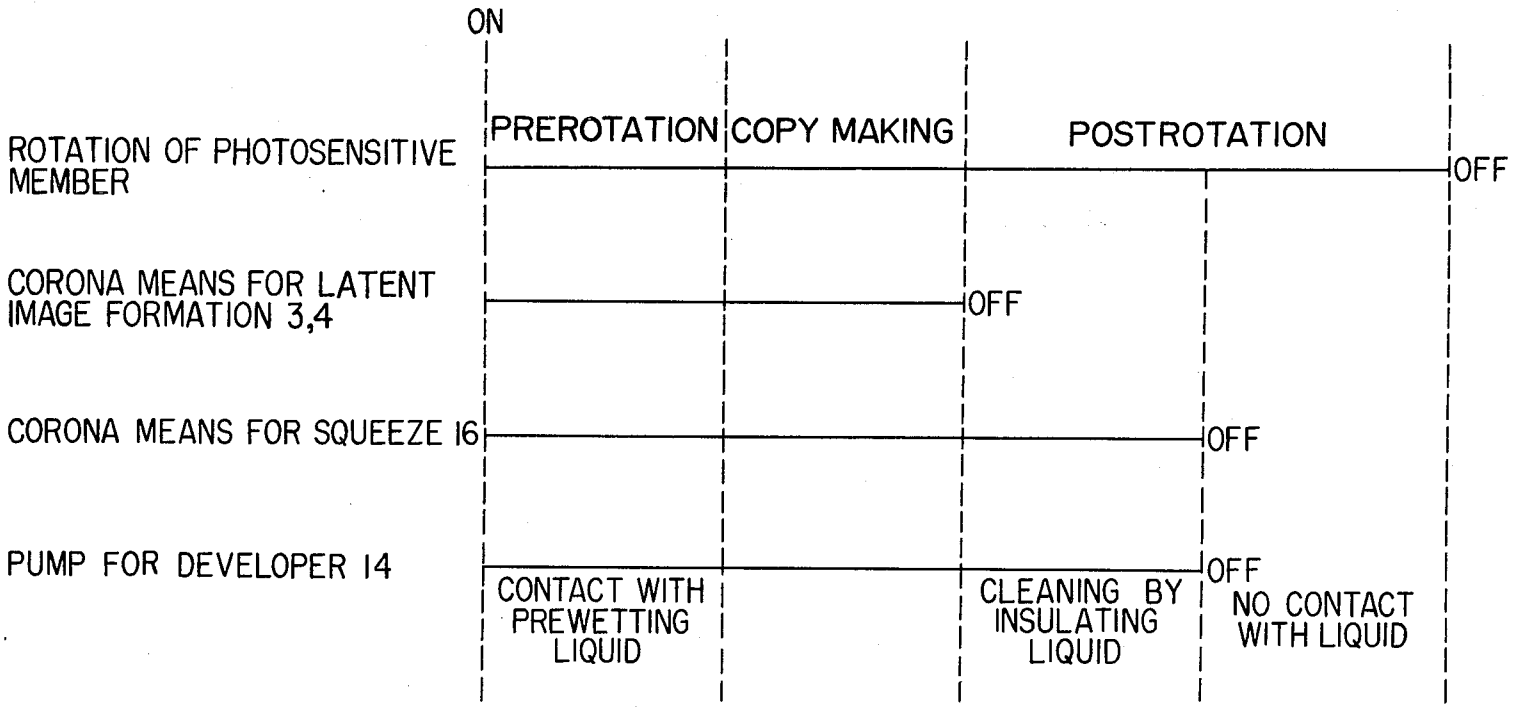
FIG. 16 illustrates an example of the operation mode of the copying apparatus according to the present invention.

The liquid thickness evening member suffers from some degree of deposition of toner during its contact with the developing liquid. Should the toner build up and solidify on the liquid thickness uniforming member, the performance of this member would not only be hampered but also the solidified toner would contact the photosensitive layer to injure the toner image thereon. To avoid this, the liquid thickness evening member should be washed by a carrier liquid almost free of toner after the copying has been completed. More specifically, as FIG. 16 shows the time relationships, such design should be made that even after the desired copying has been completed and even if the operation of the corona dischargers 3 and 4 for the latent image formation have been stopped, the rotation of the photosensitive drum 1 whose surface potential has become zero (or may be of the same polarity as the toner) and the operation of the corona discharger 16 (or air knife) and of the pump 14 still continues so that the photosensitive drum 1 carries developing liquid almost free of toner and brings it into contact with the uniforming member, thereby washing away the toner which was deposited on the uniforming member during the copying process. At a point of time whereat the uniforming member has been washed up, the operation of the corona discharger 16 (or air knife) and of the pump 14 for the supply of developing liquid may be stopped while the rotation of the drum 1 is still continued for a predetermined time to drain the developing liquid off the liquid thickness uniforming member and the drum surface. Before the copying process also, the photosensitive drum 1 is rotated and the liquid squeeze corona discharge 16 (or air knife) and the developing liquid supply pump 14 are operated in order to wet the photosensitive layer prior to the copying process and to keep the squeezed developing liquid in uniform and stable contact with the liquid thickness evening member so that the thickness of the squeezed liquid may already become uniform by the time the copying is started. According to the present invention, as will be apparent, the times required for the pre-rotation and for the post-rotation are shortened.

The material of the liquid thickness evening member may preferably be a flexible elastomer like rubber. This is to prevent this member from damaging the photosensitive layer by contacting the same during assembly or disassembly of the apparatus. Where no such fear is expected, the liquid thickness evening member may be formed of a metal or hard synthetic resin or the like.

The present invention is applicable not only to the electrophotographic apparatuses of the image transfer type but also to the electrophotographic apparatuses of the type in which toner images are directly fixed on latent image bearing members. The invention is further applicable to the electrophotographic apparatuses directed to the copying of documents and the like, as well as all the apparatuses of the type in which electrostatic latent images are first formed and then liquid-developed, such as the electrophotographic apparatuses in which electrical signal output from an electric computer or a communication receiver set is converted into light signal and applied to an electrophotographic sensitive medium.

What we claim is:

1. An electrophotographic apparatus comprising:

a movable photosensitive medium which at least moves upwardly along its path of movement;

means for forming an electrostatic latent image on said photosensitive medium;

developing means for supplying developing liquid to the surface of said photosensitive medium to develop the electrostatic latent image thereon into a toner image;

squeeze power forming means disposed downstream of said developing means with respect to the path of movement of said photosensitive medium, and opposed to said photosensitive medium at a position where said photosensitive medium moves upwardly, said squeeze power forming means being spaced from the layer of developing liquid formed on said photosensitive medium;

a liquid thickness evening member disposed to contact the developing liquid dammed up and bulged by the action of said squeeze power forming means to make uniform the thickness of the layer of developing liquid squeezed by said squeeze power forming means and which then flows down said photosensitive medium, said liquid thickness evening member being provided with a liquid-contacting surface having a planar surface region which is substantially parallel to the surface of said photosensitive medium, and a contiguous sloped surface region which extends downwardly from said planar surface region, wherein the clearance between said sloped surface region and the surface of said photosensitive medium continuously increases in the direction opposite to the direction of movement of said photosensitive medium.

2. An apparatus according to claim 1, wherein said sloped surface region is flat.

3. An apparatus according to claim 1, wherein said sloped surface region includes a plurality of contiguous flat surface regions.

4. An apparatus according to claim 1, wherein said sloped surface region is a convex surface.

5. An apparatus according to claim 1, further comprising image transfer means for transferring the toner image from said photosensitive medium to a transfer medium after unnecessary developing liquid has been removed from said photosensitive medium.

6. An electrophotographic apparatus comprising:

a movable photosensitive medium which at least moves upwardly along its path of movement;

means for forming an electrostatic latent image on said photosensitive medium;

developing means for supplying developing liquid containing toner to the surface of said photosensitive medium to develop the electrostatic latent image thereon into a toner image;

corona discharge means disposed downstream of said developing means with respect to the path of movement of said photosensitive medium, and opposed to said photosensitive medium at a position where said photosensitive medium moves upwardly; and a liquid thickness evening member disposed to contact the developing liquid dammed up and bulged by the action of said corona discharge means in order to make uniform the thickness of the layer of developing liquid squeezed by said corona discharge means and which then flows down said photosensitive medium, said liquid thickness evening member being provided with a liquid-contacting surface having a planar surface region substantially parallel to the surface of said photosensitive medium, and a contiguous sloped surface region extending downwardly from said planar surface region, wherein a clearance between said sloped surface region and the surface of said photosensitive medium continuously increases in the direction opposite to the direction of movement of said photosensitive medium.

7. An apparatus according to claim 6, wherein said sloped surface region is flat.

8. An apparatus according to claim 6, wherein said sloped surface region includes a plurality of contiguous flat surface regions.

9. An apparatus according to claim 6, wherein said sloped surface region is a convex surface.

10. An apparatus according to claim 6, wherein said corona discharge means comprises a discharge electrode, a shield member and a corona discharge current converging member forming a discharge current passage opening.

11. An apparatus according to claim 10, wherein said liquid thickness evening member is projected integrally from said converging member.

12. An apparatus according to claim 10, wherein said liquid thickness evening member is spaced apart from said converging member and is disposed between said converging member and said photosensitive medium.

13. An apparatus according to claim 6, wherein the discharging polarity of said corona discharge means is the same as the polarity of the toner in the developing liquid.

14. An apparatus according to claim 6, further comprising image transfer means for transferring the toner image from said photosensitive medium to a transfer medium after unnecessary developing liquid has been removed from said photosensitive medium.

15. An electrophotographic apparatus comprising:

a movable photosensitive medium which at least moves upwardly along its path of movement;

means for forming an electrostatic latent image on said photosensitive medium into a toner image;

developing means for supplying developing liquid to the surface of said photosensitive medium to develop the electrostatic latent image thereon;

gas stream injection means disposed downstream of said developing means with respect to the path of movement of said photosensitive medium, and opposed to said photosensitive medium at a position where said photosensitive medium moves upwardly; and a liquid thickness evening member disposed to contact the developing liquid dammed up and bulged by the action of said gas stream injection means in order to make uniform the thickness of the layer of developing liquid squeezed by said gas stream injection means and which then flows down said photosensitive medium, said liquid thickness evening member being provided with a liquid-contacting surface having a planar surface region substantially parallel to the surface of said photosensitive medium, and a contiguous sloped surface region which extends downwardly from said planar surface region, wherein a clearance between said sloped surface region and the surface of said photosensitive medium continuously increases in the direction opposite to the direction of movement of said photosensitive medium.

16. An apparatus according to claim 15, wherein said sloped surface region is flat.

17. An apparatus according to claim 15, wherein said sloped surface region includes a plurality of contiguous flat surface regions.

18. An apparatus according to claim 15, wherein said sloped surface region is a convex surface.

19. An apparatus according to claim 15, further comprising image transfer means for transferring the toner image from said photosensitive medium to a transfer medium after unnecessary developing liquid has been removed from said photosensitive medium.

20. An electrophotographic apparatus comprising:

a rotatable latent image bearing drum;

means for forming an electrostatic latent image on said latent image bearing drum;

means for supplying liquid developer containing toner to said latent image bearing drum to develop the electrostatic latent image thereon into a toner image;

squeeze power forming means disposed downstream of said liquid developer supplying means with respect to the path of rotational movement of said drum, and opposed to said drum at a position where said drum moves upwardly; said squeeze power forming means being spaced from the layer of developing liquid formed on said drum;

a liquid layer control member disposed to contact the developing liquid dammed up and bulged by the action of said squeeze power forming means in order to make uniform the thickness of the layer of developing liquid squeezed by said squeeze power forming means and which then flows down said drum, said liquid layer control member being provided with a liquid-contacting surface having a planar surface region substantially parallel to the peripheral surface of said latent image bearing drum, and a contiguous sloped surface region which extends downwardly from said planar surface region, wherein a clearance between said sloped surface region and the peripheral surface of said drum continuously increases in the direction opposite to the direction of rotation of said drum; and image transfer means for transferring the toner image from said drum to a transfer medium after unnecessary developing liquid has been removed from said drum.

21. An apparatus according to claim 20, wherein said sloped surface region is flat.

22. An apparatus according to claim 20, wherein said sloped surface region includes a plurality of contiguous flat surface regions.

23. An apparatus according to claim 20, wherein said sloped surface region is a convex region.

24. An apparatus according to claim 20, wherein said squeeze power forming means is a corona discharge means.

25. An apparatus according to claim 24, wherein said corona discharge means comprises a discharge electrode, a shield member and a corona discharge current converging member forming a discharge current passage opening.

26. An apparatus according to claim 25, wherein said liquid layer control member is projected integrally from said corona discharge converging member.

27. An apparatus according to claim 25, wherein said liquid layer control member is spaced apart from said corona discharge converging member and disposed between said converging member and the peripheral surface of said latent image bearing drum.

28. An apparatus according to claim 24, wherein the discharging polarity of said corona discharge means is the same as the polarity of the toner in said liquid developer.

* * * * *

UNITED STATES PATENT OFFICE

CERTIFICATE OF CORRECTION

Patent No. 4,161,361 Dated July 17, 1979

Inventor(s) IKUO SOMA, ET AL.

It is certified that error appears in the above-identified patent and that said Letters Patent are hereby corrected as shown below:

Column 11, line 30, "uniforming" should read --evening--;

Column 11, line 37, "uniforming" should read --evening--;

Column 12, line 7, "pump 30" should read --pipe 30--.

Signed and Sealed this

First Day of January 1980

[SEAL]

Attest:

SIDNEY A. DIAMOND

Attesting Officer

Commissioner of Patents and Trademarks